US011851247B2

(12) United States Patent
Migas et al.

(10) Patent No.: US 11,851,247 B2
(45) Date of Patent: Dec. 26, 2023

(54) TWIST AND FLIP CLOSURE

(71) Applicant: Closure Systems International Inc., Memphis, TN (US)

(72) Inventors: Jeremiah Migas, Crawfordsville, IN (US); Jeremy Morin, Zionsville, IN (US); Marina Lennartz, Liberty Township, OH (US)

(73) Assignee: Closure Systems International Inc., Indianapolis, IN (US)

( * ) Notice: Subject to any disclaimer, the term of this patent is extended or adjusted under 35 U.S.C. 154(b) by 676 days.

(21) Appl. No.: 16/502,641

(22) Filed: Jul. 3, 2019

(65) Prior Publication Data

US 2020/0017260 A1 Jan. 16, 2020

Related U.S. Application Data

(60) Provisional application No. 62/696,522, filed on Jul. 11, 2018.

(51) Int. Cl.
*B65D 41/34* (2006.01)
*B65D 43/16* (2006.01)

(52) U.S. Cl.
CPC ..... *B65D 41/3428* (2013.01); *B65D 43/162* (2013.01)

(58) Field of Classification Search
CPC ..... B65D 2401/30; B65D 41/34; B65D 41/3428; B65D 43/162; B65D 51/248; B65D 55/16
(Continued)

(56) References Cited

U.S. PATENT DOCUMENTS 3,904,062 A 9/1975 Grussen
4,394,918 A 7/1983 Grussen
(Continued)

FOREIGN PATENT DOCUMENTS

CN 1175930 A 3/1998
CN 101258079 A 9/2008
(Continued)

OTHER PUBLICATIONS

International Search Report and Written Opinion for International Application No, PCT/U82019/040602, dated Oct. 2, 2019 (12 pages).

(Continued)

*Primary Examiner* — James N Smalley
*Assistant Examiner* — Madison L Poos
(74) *Attorney, Agent, or Firm* — Nixon Peabody LLP

(57) ABSTRACT

A flip-top closure includes first and second closure portions. The first closure portion includes a polymeric top wall portion, a sealing mechanism, and a polymeric annular skirt portion depending from the top wall portion. The skirt portion includes an internal thread formation for mating with a container. The second closure portion includes a polymeric tamper-evident band depending from and being partially detachably connected to the skirt portion by a frangible connection. The frangible connection extends partially around the periphery of the closure. The first and second closure portions are attached via at least one hinge. The at least one hinge assists in moving the closure between an open and closed positions after the frangible connection has been broken.

25 Claims, 6 Drawing Sheets

(58) Field of Classification Search
USPC ..... 215/44
See application file for complete search history.

(56) References Cited

U.S. PATENT DOCUMENTS

| | | | | |
|---|---|---|---|---|
| 4,805,792 | A | 2/1989 | Lecinski | |
| 5,215,204 | A | 6/1993 | Beck | |
| 5,246,125 | A | 9/1993 | Julian | |
| 5,725,115 | A | 3/1998 | Bosl | |
| 6,123,212 | A | 9/2000 | Russell | |
| 6,367,668 | B1 | 4/2002 | Schwanenberg | |
| 6,474,491 | B1 | 11/2002 | Benoit-Gonin | |
| 6,481,588 | B1 | 11/2002 | Wagner | |
| 7,051,888 | B2 | 5/2006 | Antier | |
| D593,856 | S | 6/2009 | Kubler | |
| 8,469,213 | B2 | 6/2013 | Ishii | |
| 8,485,374 | B2 | 7/2013 | Gevers | |
| 8,763,830 | B2 | 7/2014 | Sadiq | |
| 8,794,460 | B2 | 8/2014 | Druitt | |
| 9,010,555 | B2 | 4/2015 | Luzzato | |
| 9,085,385 | B1 | 7/2015 | Costanzo | |
| 9,126,726 | B2 | 9/2015 | Edie | |
| 9,439,523 | B2 * | 9/2016 | Naesje | A47G 19/2272 |
| 9,643,762 | B2 | 5/2017 | Maguire | |
| 2002/0088813 | A1 | 7/2002 | Nyman | |
| 2003/0002980 | A1 | 1/2003 | Torre | |
| 2004/0178166 | A1 | 9/2004 | Antier | |
| 2006/0163188 | A1 | 7/2006 | Lagler | |
| 2008/0011704 | A1 | 1/2008 | Van Ryn | |
| 2009/0045158 | A1 | 2/2009 | Suriol | |
| 2010/0005641 | A1 | 1/2010 | Druitt | |
| 2010/0326948 | A1 | 12/2010 | Campbell | |
| 2011/0000871 | A1 | 1/2011 | Bernard | |
| 2011/0114593 | A1 | 5/2011 | Ishii | |
| 2011/0174760 | A1 | 7/2011 | Luzzato | |
| 2012/0024815 | A1 | 2/2012 | Kwon | |
| 2012/0298666 | A1 | 11/2012 | Kwon | |
| 2012/0305564 | A1 | 12/2012 | Hayashi | |
| 2015/0129531 | A1 * | 5/2015 | Gatton | B65D 50/041 215/201 |
| 2015/0251827 | A1 * | 9/2015 | Campbell | B65D 55/16 215/258 |
| 2015/0368009 | A1 | 12/2015 | Loukov | |
| 2016/0288961 | A1 | 10/2016 | Maguire | |
| 2017/0349336 | A1 | 12/2017 | Sadiq | |
| 2018/0009979 | A1 | 1/2018 | Nishiyama | |
| 2019/0344933 | A1 * | 11/2019 | Kim | B65D 41/0414 |

FOREIGN PATENT DOCUMENTS

| | | | | |
|---|---|---|---|---|
| CN | 102089220 | A | | 6/2011 |
| CN | 107914952 | A | | 4/2018 |
| EP | 2 308 772 | A1 | | 4/2011 |
| JP | 2003-191991 | A | | 7/2003 |
| JP | 2003191991 | A | * | 7/2003 |
| JP | 3167601 | U | | 5/2011 |
| KR | 2016-0132757 | A | | 11/2016 |
| WO | WO 03/006333 | A2 | | 1/2003 |
| WO | WO 2004/039690 | A1 | | 5/2004 |
| WO | WO 2010/004919 | A1 | | 1/2010 |
| WO | WO 2010/040961 | A1 | | 4/2010 |
| WO | WO 2014/200165 | A1 | | 12/2014 |

OTHER PUBLICATIONS

U.S. Appl. No. 16/158,475, filed Oct. 12, 2018, Jeremiah Migas, Twist and Flip Lock Closure.

* cited by examiner

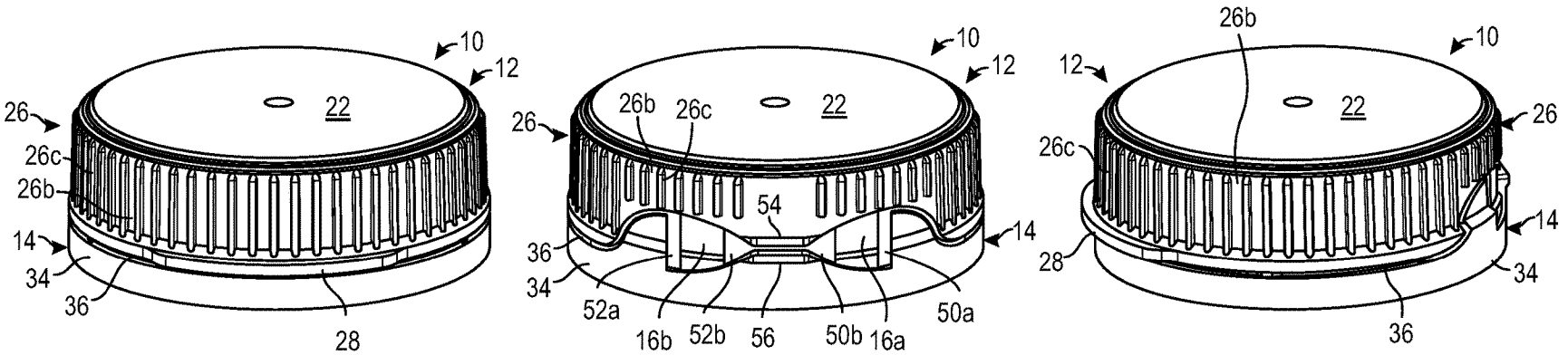
Fig. 2A
Fig. 2B
Fig. 2C
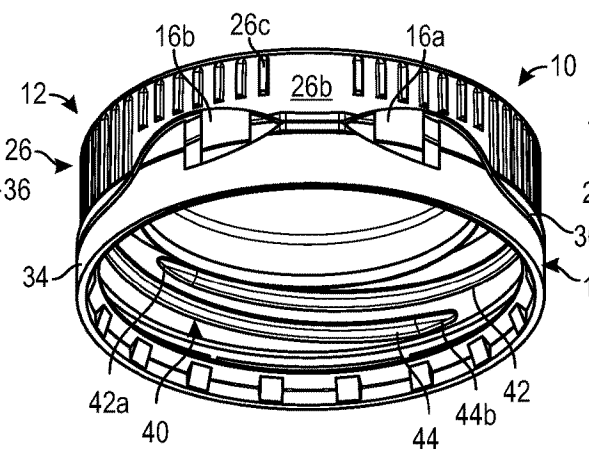
Fig. 2E
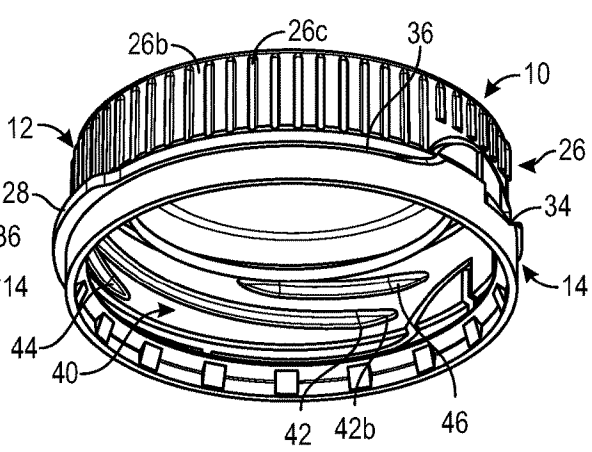
Fig. 2F
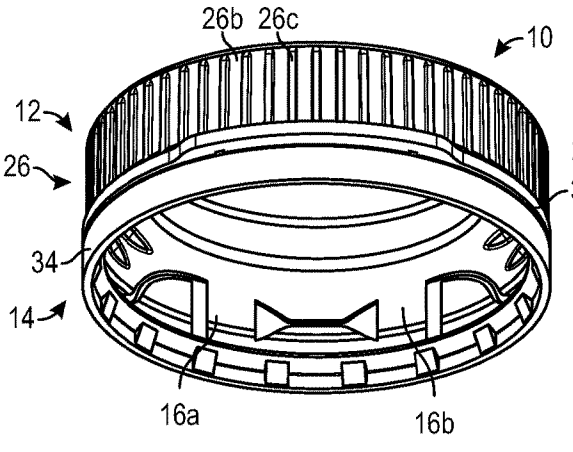
Fig. 2D

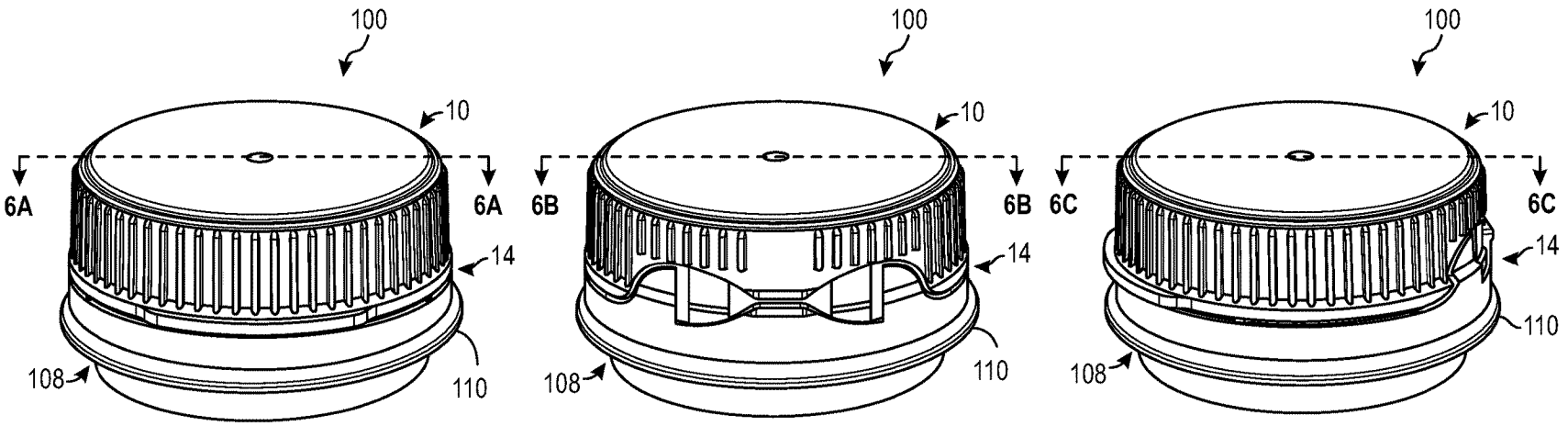
Fig. 5A
Fig. 5B
Fig. 5C
Fig. 6A
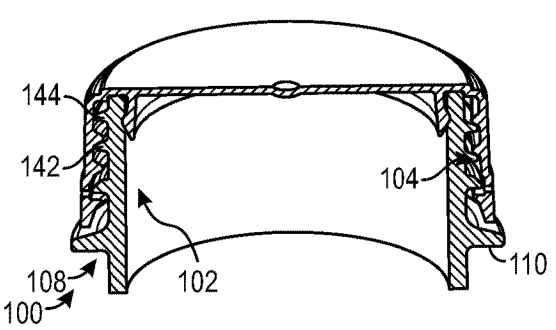
Fig. 6B
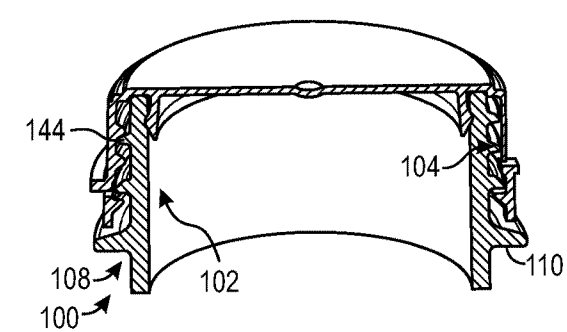
Fig. 6C

TWIST AND FLIP CLOSURE

CROSS-REFERENCE TO RELATED APPLICATION

This application claims the benefit of priority of U.S. Provisional Patent Application No. 62/696,522 filed on Jul. 11, 2018, which is incorporated by reference in its entirety.

FIELD OF THE INVENTION

The present invention relates generally to a polymeric closure for a package. More specifically, the present invention relates to a hinged flip-top polymeric closure with tamper-evident features.

BACKGROUND OF THE INVENTION

Polymeric closures have been used in many applications over the years in conjunction with containers. One type of polymeric closure that has been used with containers is a tamper-evident polymeric closure. Tamper-evident closures are used to prevent or inhibit tampering by providing a visible indication to a user if the closure has been opened. This visual indication typically divides the closure into two separate components after the tamper-evident feature has been broken.

Tamper-evident features have been used in polymeric closure that are flip-top closures. These flip-top closures typically have an upper tamper-evident feature involving a lid and a lower tamper-evident feature on a bottom of a base. Potential drawbacks of these flip-top closures include the upper tamper-evident feature being separated from the remainder of the closure and/or having a higher likelihood of being tampered with. For example, the upper tamper-evident feature may be a "pull-away" or "break-away" feature that can be separated from the remainder of the closure and thrown away. These upper tamper-evident feature are external features that have a greater likelihood of being tampered with.

If the upper tamper-evident feature is separated from the remainder of the closure and into two individual components, a portion of the flip-top closure is likely not recycled with the remainder of the closure and container. This scenario raises potential environment concerns with so many containers having tamper-evident features that can be separated into two or more individual components.

It would be desirable to provide a flip-top closure that has tamper-evident features that address these above-noted environmental concerns, while still performing all of the desirable properties of a closure.

SUMMARY

According to one embodiment, a flip-top closure comprises a first closure portion and a second closure portion. The first closure portion includes a polymeric top wall portion, a sealing mechanism, and a polymeric annular skirt portion depending from the polymeric top wall portion. The polymeric annular skirt portion includes an internal thread formation for mating engagement with an external thread formation of a container. The second closure portion includes a polymeric tamper-evident band depending from and being partially detachably connected to the polymeric annular skirt portion by a frangible connection. The frangible connection extends partially around the periphery of the closure. The first closure portion and the second closure portion are attached via at least one hinge. The at least one hinge assists in moving the closure between an open position and a closed position after the frangible connection has been broken.

According to one embodiment, a package comprises a container and a flip-top closure. The container has a neck portion defining an opening. The container has an external thread formation on the neck portion. The flip-top closure is configured for fitment to the neck portion of the container for closing the opening. The flip-top closure includes a first closure portion and a second closure portion. The first closure portion includes a polymeric top wall portion, a sealing mechanism, and a polymeric annular skirt portion depending from the polymeric top wall portion. The polymeric annular skirt portion includes an internal thread formation for mating engagement with the external thread formation of the container. The second closure portion includes a polymeric tamper-evident band depending from and being partially detachably connected to the polymeric annular skirt portion by a frangible connection. The frangible connection extends partially around the periphery of the closure. The first closure portion and the second closure portion are attached via at least one hinge. The at least one hinge assists in moving the closure between an open position and a closed position after the frangible connection has been broken.

According to one method, a package including a flip-top closure and a container is used. The method includes providing the container having a neck portion defining an opening. The container has an external thread formation on the neck portion. The flip-top closure including a first closure portion and a second closure portion is provided. The first closure portion includes a polymeric top wall portion, a sealing mechanism, and a polymeric annular skirt portion depending from the polymeric top wall portion. The polymeric annular skirt portion includes an internal thread formation for mating engagement with an external thread formation of a container. The second closure portion includes a polymeric tamper-evident band depending from and being partially detachably connected to the polymeric annular skirt portion by a frangible connection. The frangible connection extends partially around the periphery of the closure. The first closure portion and the second closure portion are attached via at least one hinge. The flip-top closure is fitted to the neck portion of the container in a closed position. The first and second closure portions are twisted so as to break the frangible connection partially connecting the tamper-evident band and the annular skirt portion. After the frangible connection has been broken, the closure is flipped from a closed position to an open position using the at least one hinge.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which:

FIG. 2A is a front perspective view of the flip-top closure of FIG. 1A in a closed position according to one embodiment.

FIG. 2B is a back perspective view of the flip-top closure of FIG. 1A in a closed position.

FIG. 2C is a side perspective view of the flip-top closure of FIG. 1A in a closed position.

FIG. 2D is a bottom perspective view of the flip-top closure of FIG. 2A in a closed position.

FIG. 2E is a bottom perspective view of the flip-top closure of FIG. 2B in a closed position.

FIG. 2F is a bottom perspective view of the flip-top closure of FIG. 2C in a closed position.

FIG. 5A is a front perspective view of a package including the flip-top closure of FIG. 1A and a container in a closed position according to one embodiment.

FIG. 5B is a back perspective view of the package of FIG. 5A in a closed position.

FIG. 5C is a side perspective view of the package of FIG. 5A in a closed position.

FIG. 6A is a cross-sectional view taken generally along line 6A-6A in FIG. 5A.

FIG. 6B is a cross-sectional view taken generally along line 6B-6B in FIG. 5B.

FIG. 6C is a cross-sectional view taken generally along line 6C-6C in FIG. 5C.

Figure 1B:
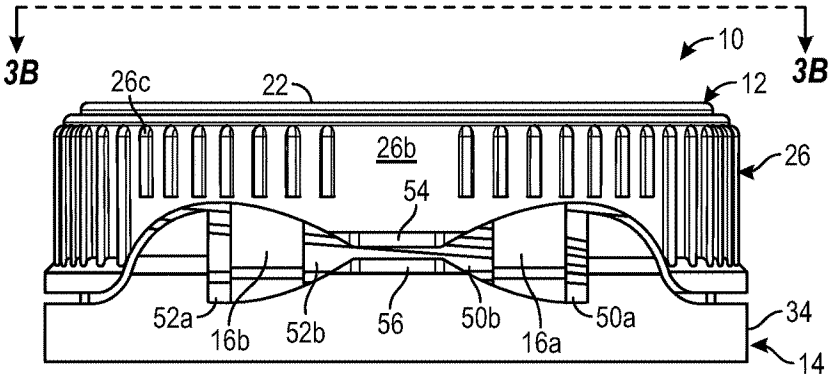
FIG. 1B is a back plan view of the flip-top closure of FIG. 1A in a closed position.
Figure 1A:
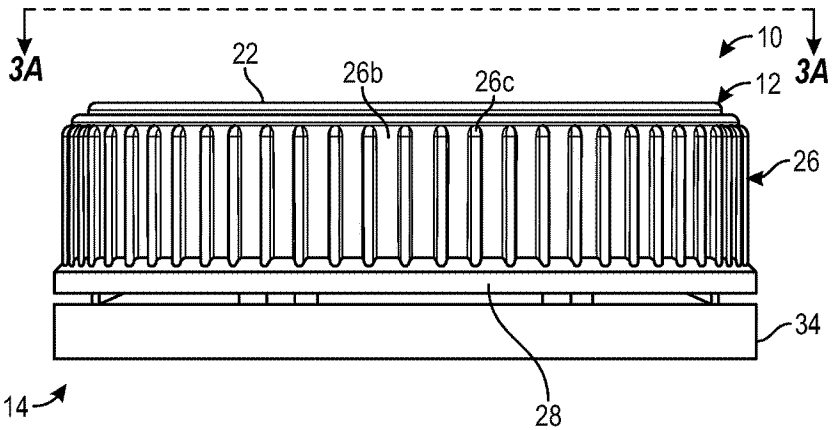
FIG. 1A is a front plan view of a flip-top closure in a closed position according to one embodiment.
Figure 3B:
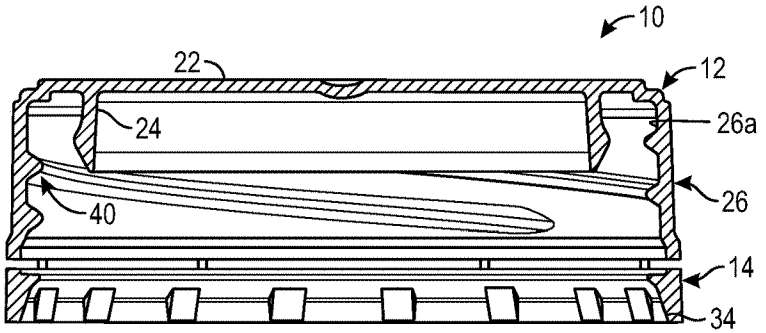
FIG. 3B is a cross-sectional view taken generally along line 3B-3B in FIG. 1B.
Figure 3A:
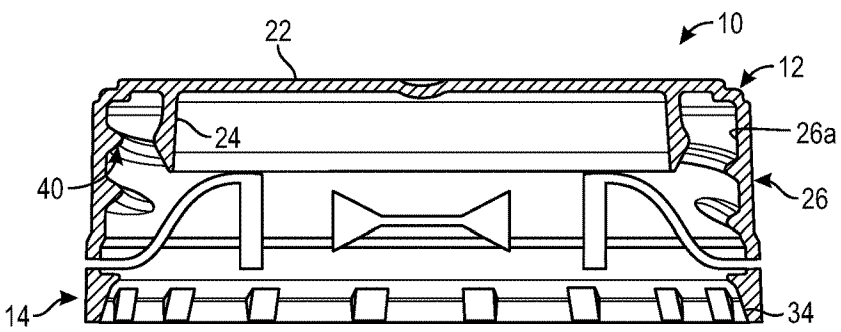
FIG. 3A is a cross-sectional view taken generally along line 3A-3A in FIG. 1A.
Figure 1D:
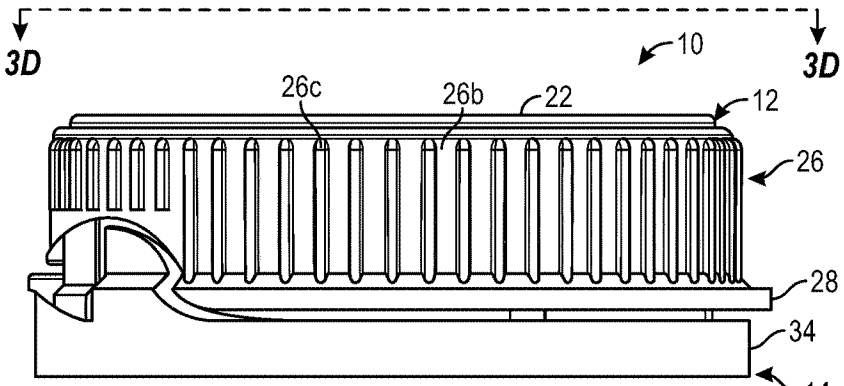
FIG. 1D is another side plan view of the flip-top closure of FIG. 1A in a closed position.
Figure 1C:
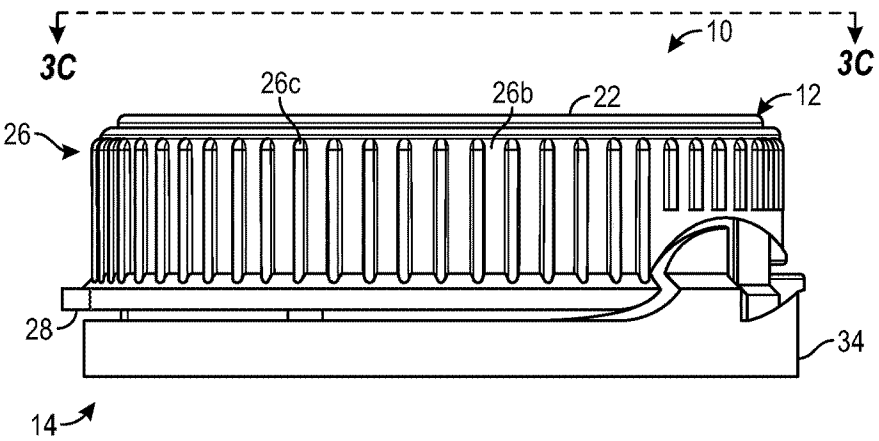
FIG. 1C is a side plan view of the flip-top closure of FIG. 1A in a closed position.
Figure 3D:
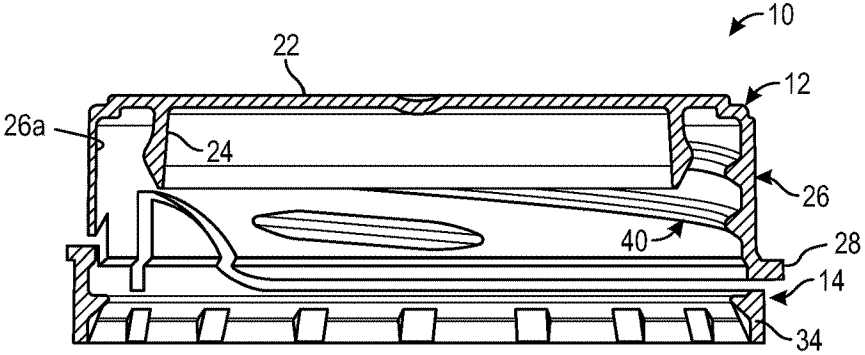
FIG. 3D is a cross-sectional view taken generally along line 3D-3D in FIG. 1D.
Figure 3C:
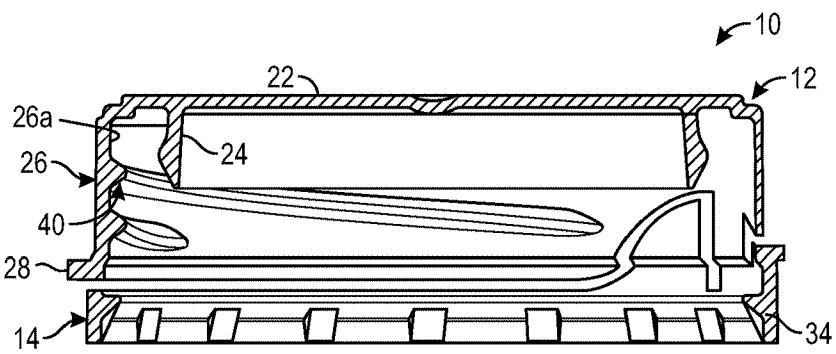
FIG. 3C is a cross-sectional view taken generally along line 3C-3C in FIG. 1C.
Figure 4B:
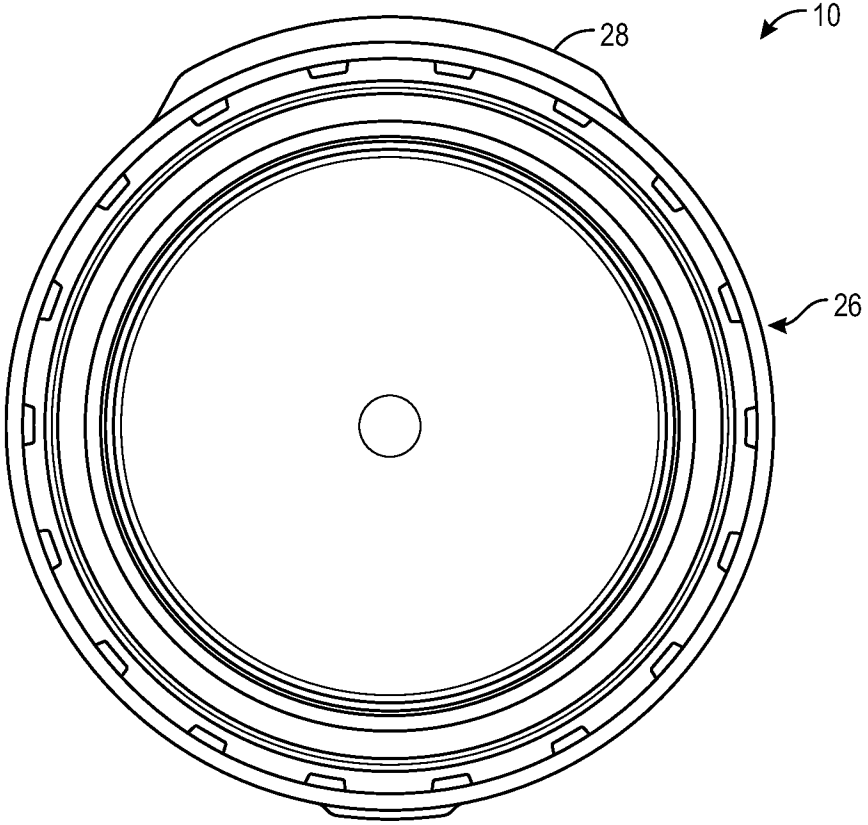
FIG. 4B is a bottom view of the flip-top closure of FIG. 1A.
Figure 4A:
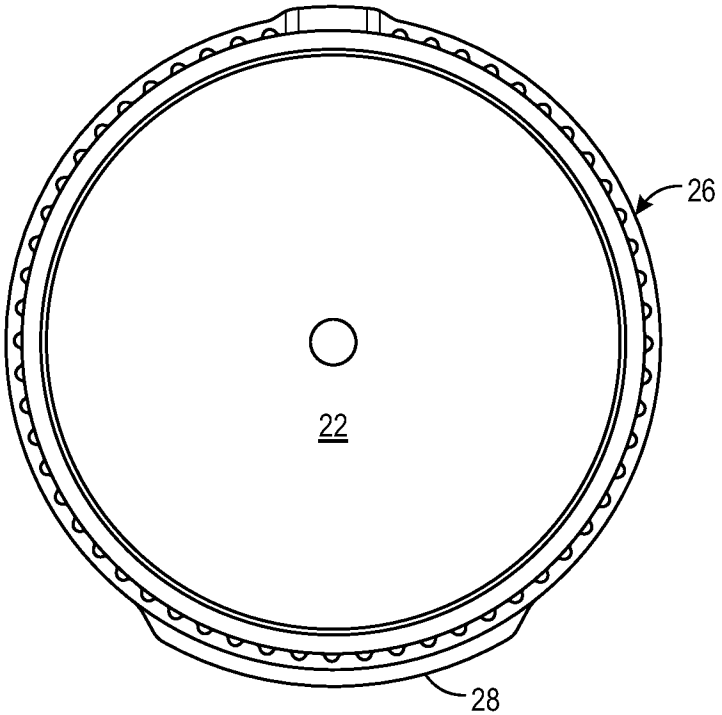
FIG. 4A is a top view of the flip-top closure of FIG. 1A.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

FIGS. 1A-1D, 2A-2F, 3A-3D and 4A-4B illustrate a polymeric flip-top closure 10 according to one embodiment of the present invention. The closures are configured to be placed on a container or bottle that contain product. The product is typically a liquid product, but also may be a solid product or a combination of a liquid and solid product. The polymeric flip-top closure 10 is generally cylindrically shaped. The flip-top closure is configured to remain in one piece with the container so as to reduce environmental waste, while still providing desirable tamper-evident features. The flip-top closure of the present invention assists in reducing the upward removal force that would otherwise be needed to break the tamper-evident band if the closure functioned solely with a hinge design. In other words, the flip-top closure of the present invention assists in decreasing the removal force needed to open the closure when attached to a container.

Referring still to FIGS. 1A-1D, 2A-2F, 3A-3D and 4A-4B, the polymeric closure 10 includes a first closure portion or lid 12 and a second closure portion or base 14. The polymeric closure 10 is a one-piece closure. The first closure portion and the second closure portion are connected via at least one hinge. As shown best in FIGS. 1B, 2B and 2D, the first closure portion 12 and the second closure portion 14 include a first hinge 16*a* and a second hinge 16*b*. It is contemplated that the first closure portion and the second closure portion may be connected via one hinge in another embodiment.

The first closure portion 12 includes a polymeric top wall portion 22, a polymeric continuous plug seal 24 (see FIGS. 3A-3D) and a polymeric annular skirt portion 26. The second closure portion 14 includes a polymeric tamper-evident band 34.

As shown in FIGS. 3A-3D, the polymeric continuous plug seal 24 depends from the polymeric top wall portion 22 and provides a sealing mechanism. The continuous plug seal 24 is spaced from an interior surface 26*a* of the polymeric annular skirt portion 26 when the flip-top closure 10 is in a closed position.

In one embodiment, the polymeric continuous plug seal may include interlocking bumps. In such an embodiment, the polymeric continuous plug seal includes a first end and a second end. The second end is located farther away from the polymeric top wall portion than the first end. The polymeric continuous plug seal includes interlocking bumps at a second end to assist in snapping the first closure portion into the second closure portion. The interlocking bumps desirably give an audible sound to a user that the first closure portion and the second closure portion have been snapped into a closed position.

In another embodiment, the flip-top closure may include other sealing mechanisms. For example, the closure may include a polymeric lining material that provides a seal to the closure. In this embodiment, the closure would be formed from separate components, but would function as the one-piece closure discussed except with a different sealing mechanism. In another embodiment, the closure may include a polymeric outer seal with or without a continuous plug seal. It is contemplated that the flip-top closure may include other sealing mechanisms.

The polymeric annular skirt portion 26 depends from the polymeric top wall portion 22. The polymeric annular skirt portion 26 includes an internal thread formation 40 for mating engagement with an external thread formation of a container. As shown in FIGS. 2D-2F, the internal thread formation includes a first closure lead 42, a second closure lead 44 and a third lead 46.

The first closure lead 42 begins near the polymeric top wall portion 22 at a first position 42*a* (see FIG. 2E) and extends in a helical fashion to a second position 42*b* (see FIG. 2F) closer to the tamper-evident band 34. Similarly, the second closure lead 44 begins near the polymeric top wall portion 22 at a first position (not shown) and extends in a helical fashion to a second position 44*b* (see FIG. 2E) closer to the tamper-evident band 34. The first, second and third closure leads 42, 44, 46 are referred collectively as a triple lead closure thread. The first, second and third closure leads 42, 44, 46 are continuous. As shown in FIGS. 2D-2F, the first, second and third closure leads 42, 44, 46 do not extend into the general area where the first and second hinges 16*a*, 16*b* are located.

As shown in FIGS. 2D-2F, the first, second and third closure leads 42, 44, and 46 are offset relative to each other and do not collectively extend around the entire periphery of the closure. In one embodiment, the closure leads collectively extend from about 225 to about 325 degrees around the interior periphery of the closure. In another embodiment, the closure leads collectively extend from about 250 to about 325 degrees around the interior periphery of the closure. In a further embodiment, the closure leads collectively extend from about 275 to about 325 degrees around the interior periphery of the closure. In a further embodiment, the closure leads collectively extend from about 275 to about 300 degrees around the interior periphery of the closure.

It is desirable for the thread formation not to collectively extend around the entire periphery. More specifically, it is desirable for the thread formation to be absent in the area where the at least one hinge is located. This will assist in preventing or inhibiting (1) the thread formation from potentially interfering with the desired functionality of the at least one hinge; and (2) the second closure portion from being moved and not remaining in its initial location.

It is contemplated that the first, second and third closure leads may be discontinuous. It is also contemplated that the internal thread formation of the closure may differ from a helical thread formation. It is also contemplated that other types or numbers of internal thread formations may be used in the closure. For example, the internal thread formation may include a double threaded structure having first and second closure leads.

As shown in FIGS. 1C, 1D, 2C and 4A, for example, the first closure portion 12 further includes a flip tab 28. The flip tab 28 is an extension that extends outwardly from the remainder of the first closure portion 12. The flip tab 28 is of a generally thin, flat rectangular shape. It is contemplated that the size and shape of the flip tab may be different than depicted in FIGS. 1C, 1D, 2C and 4A. The flip tab 28 is located generally opposite of the first and second hinges 16*a*, 16*b*. The flip tab 28 assists a user in flipping the closure 10 from a closed position to an open position. Specifically, the flip tab 28 provides a surface for a user to grasp when flipping the closure 10 from a closed position to an open position.

The second closure portion 14 includes the polymeric tamper-evident band 34 depending from and being partially detachably connected to the polymeric annular skirt portion 26 by a frangible connection 36. The tamper-evident band 34 is configured to partially detach the first and second closure portions 12, 14 by twisting the first closure portion 12 and the second closure portion 14. This twisting is performed by the torque created by a user of the closure, resulting in the first closure portion 12 engaging the thread formation of the container and riding up that results in breaking the frangible connection 36.

The frangible connection 36 extends partially around the periphery of the closure. As shown in FIGS. 2B and 2E, the frangible connection 36 does not extend into the area where the hinges 16*a*, 16*b* are located. The frangible connection 36 is shown in FIGS. 2B and 2E as having a shark fin or wave-like shape as it nears the location of the hinges 16*a*, 16*b*. The remainder of the frangible connection 36 is a generally straight line conforming with the periphery of the closure. It is contemplated that the frangible connection may be entirely a generally straight line conforming with the periphery of the closure. It is contemplated that the frangible connection may be of other shapes.

The frangible connection extends from about 225 degrees to about 325 degrees around the periphery of the closure in one embodiment. The frangible connection extends from about 250 degrees to about 325 degrees around the periphery of the closure in another embodiment. The frangible connection extends from about 275 degrees to about 325 degrees around the periphery of the closure in a further embodiment.

Referring back to FIGS. 1A-1D and 2A-2F, an outer surface 26*b* of the polymeric annular skirt portion 26 may also include a plurality of ridges 26*c* thereon. The plurality of ridges 26*c* may assist a user in (1) twisting the first closure portion 12 and the second closure portion 14 in breaking the frangible connection 36; and/or (2) gripping when moving the flip-top closure 10 between closed and open positions.

Referring specifically to FIGS. 2A-2F, the polymeric tamper-evident band 34 of the closure 10 is located at the bottom thereof (i.e., an end opposite of the polymeric top wall portion 22). The tamper-evident band 34 depends from and is partially detachably connected to the annular skirt portion 26 by the frangible connection 36. As viewed in FIG. 1C, for example, the polymeric tamper-evident band 34 is a lower tamper-evident feature. The tamper-evident band 34 works in conjunction with the container to indicate to a user that the contents of the container may have been accessed. More specifically, the tamper-evident band 34 is designed to partially separate from the annular skirt portion 26 if a user opens the package by twisting and gaining access to the container.

Figure 7:
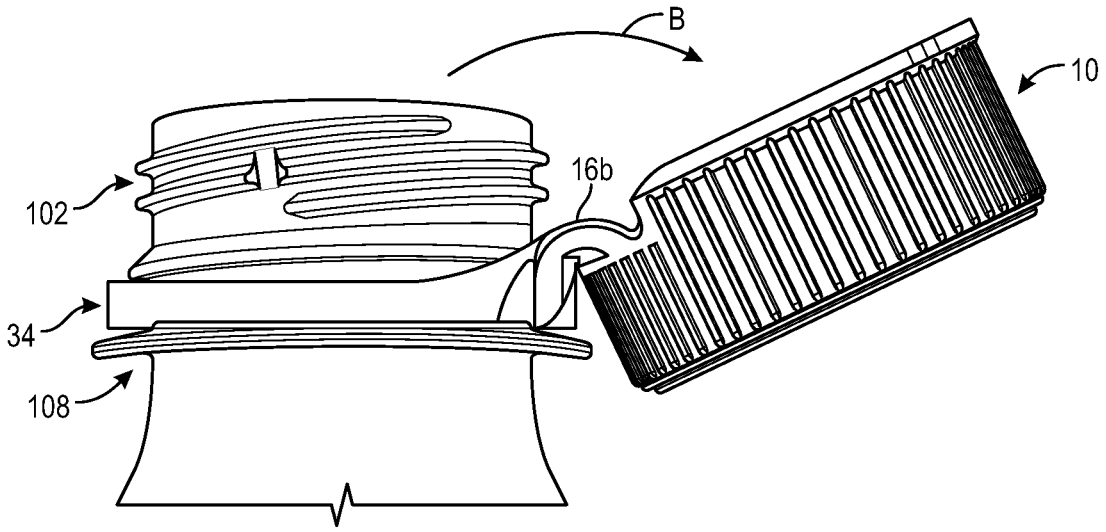
FIG. 7 is a side plan view of the closure and container of FIG. 5A in an open position.

The first closure portion 12 and the second closure portion 14 are attached by the first hinge 16*a* and second hinge 16*b*. The hinges 16*a*, 16*b* assist in moving the flip-top closure 10 between an open position and a closed position. The hinge 16*b* (the hinge 16*a* is hidden) is shown in FIG. 7 in the open position with the closure 10 and container 108. The hinges 16*a*, 16*b* are shown in FIGS. 1B and 2B in the closed position. As shown in FIGS. 1B and 2B, the first closure portion 12 and the second closure portion 14 assist to form spaces 50*a*, 50*b* adjacent to the hinge 16*a*. Similarly, the first closure portion 12 and the second closure portion 14 assist to form spaces 52*a*, 52*b* adjacent to the hinge 16*b*. The spaces assist in creating optimal hinge performance by assisting in the opening and closing of the first closure portion with respect to the second closure portion. It is contemplated that the spaces may be of different sizes and shapes than that shown in FIGS. 1B and 2B.

The first closure portion 12 further includes a first projection 54 being located between the first and second hinges 16*a*, 16*b*. The second closure portion 14 further includes a second projection 56 being located between the first and second hinges 16*a*, 16*b*. The first and second projections 54, 56 are spaced apart from each other and assist in providing an audible sound when the closure 10 is moved from a closed position to an open position.

The hinges 16*a*, 16*b* are adapted to flip or rotate at least about 130 degrees from a closed position to an open position generally along arrow B of FIG. 7. It is more desirable for the hinges 16*a*, 16*b* to flip or rotate at least about 150 degrees or even more desirably at least 170 degrees from a closed position to an open position. It is contemplated that if one hinge were used, the hinge would be adapted to flip or rotate at least 130 degrees from a closed position to an open position, more desirable from about 150 degrees from a closed position to an open position and even more desirably at least 170 degrees from a closed position to an open position.

After rotation of the hinges 16*a*, 16*b* that results in the closure 10 being moving from a closed position to an open position, the hinges 16*a*, 16*b* are desirably configured to be snapped closed so that a user when drinking the contents from the container will not be interfered with by the first closure portion 12. To close the container, the hinges 16*a*, 16*b* are unsnapped and then rotated back such the container will be in a closed position.

The frangible connection 36 may be formed by molded-in-bridges in one embodiment. The molded-in-bridges are typically formed using a feature in the mold. In another embodiment, the first and second frangible connections may be formed using scoring or scored lines, notches, leaders, nicks or other lines of weaknesses.

One non-limiting example of a flip-top closure and a container forming a package is shown and discussed in conjunction with FIGS. 5A-5C and 6A-6C. The closure 10 may be used with a conventional container in one embodiment. It is contemplated that the closure 10 may be used with other containers.

The closures of the present invention may be used with a container 108 used to form a package 100 of FIGS. 5A-5C and 6A-6C. A portion of the container 108 is shown in FIGS. 5A-5C and 6A-6C includes a neck portion 102 that defines an opening. The neck portion 102 of the container 108 includes an external thread formation 104 and a continuous outer ring 110. The external thread formation 104 includes a first finish lead 142 and a second finish lead 144 (FIGS. 6A-6C). The external thread formation 104 (finish leads 142, 144) engages with the corresponding internal thread formation 30 (closure leads 42, 44, 46) to seal the package 100.

The first finish lead 142 begins near the open end of the container 108 and extends in a helical fashion to a second position that is closer to the closed end of the container. Similarly, the second finish lead 144 starts closer to the open end of the container 108 and extends in a helical fashion to a second position that is closer to the closed end of the container. Each of the first and second finish leads 142, 144 is continuous. The first positions of the first and second finish leads 142, 144 are desirably located roughly 180 degrees apart from each other and, thus, begin on opposing sides of the neck 102 of the container 108. It is contemplated that the external thread formation of the container may have discontinuous leads.

It is contemplated that the external thread formation of the container may be different than that disclosed with respect to container 108.

The continuous outer ring 110 assists in positioning the tamper-evident band 34 if the first closure portion 12 is unthreaded from the neck 102 of the container 108 after breaking of the frangible connection 36.

The closures of the present invention may include an oxygen-scavenger material. This oxygen-scavenger material may be distributed within the closure or may be a separate layer. The oxygen-scavenger material may be any material that assists in removing oxygen within the container, while having little or no effect on the contents within the container.

Alternatively, or in addition to, the closures may include an oxygen-barrier material. The oxygen-barrier material may be added as a separate layer or may be integrated within the closure itself. The oxygen-barrier materials assist in preventing or inhibiting oxygen from entering the container through the closure. These materials may include, but are not limited to, ethylene vinyl alcohol (EVOH). It is contemplated that other oxygen-barrier materials may be used in the closure.

Additionally, it is contemplated that other features may be included in the closure described above. For example, U.S. Publication No. 2018/009979, U.S. Publication No. 2017/0349336, U.S. Pat. Nos. 9,126,726, 9,085,385, 8,763,830, 8,485,374, U.S. Publication No. 2009/0045158 and U.S. Pat. No. 6,123,212 all include features that could be incorporated in the closures of the present invention. All of these references are hereby incorporated by reference in their entireties.

The top wall portion 22, the continuous plug seal 24 and the annular skirt portion 26 are made of polymeric material. The top wall portion 22, the continuous plug seal 24, and the annular skirt portion 26 are typically made of an olefin (e.g., polyethylene (PE), polypropylene (PP)), polyethylene terephthalate (PET) or blends thereof. One example of a polyethylene that may be used in high density polyethylene (HDPE). It is contemplated that the top wall portion, the continuous plug seal and the annular skirt portion may be made of other polymeric materials. The tamper-evident band 34 is typically made of the same materials as the top wall portion 22, continuous plug seal 24 and the annular skirt portion 26.

The closures are typically formed by processes such as injection or compression molding, extrusion or the combination thereof.

The container 108 is typically made of polymeric material. One non-limiting example of a material to be used in forming a polymeric container is polyethylene terephthalate (PET), polypropylene (PP) or blends using the same. It is contemplated that the container may be formed of other polymeric or copolymer materials. It is also contemplated that the container may be formed of glass. The container 108 typically has an encapsulated oxygen-barrier layer or oxygen barrier material incorporated therein.

In one method to open the container 108 and gain access to the product therein, the first and second closure portions 12, 14 are twisted so as to break the frangible connection 36 connecting the tamper-evident band 34 and the annular skirt portion 26. The frangible connections are broken when the first and second closure portions 12, 14 are rotated and the first closure portion 12 engages the threads of the container 108 and rides up resulting in the frangible being broken. At this juncture, the first and second closure portions 12, 14 are partially separated from each other. Since the tamper evident band 34 is partially separated from the reminder of the closure via the frangible connection 36, this indicates that the closure 10 may have been accessed.

After the frangible connection 36 has been broken, the closure 10 is flipped from a closed position to an open position using the hinges 16*a*, 16*b* and the flip tab 28, if present. The first closure portion 12 is rotated at least about 130 degrees and preferably at least about 150 or at least about 170 degrees with respect to the second closure portion 14. After the closure 10 has been flipped, the product can be accessed in the container 10. More specifically, after the frangible connection 36 has been broken, the first closure portion 12 flips up so a user can bend the first closure portion 12 back to drink from the container. As discussed above, the hinges 16*a*, 16*b* are desirably configured to be snapped closed so that a user when drinking the contents from the container will not be interfered with by the first closure portion 12. To close the container, the hinges 16*a*, 16*b* are unsnapped and then rotated back such the container will return to a closed position.

The polymeric closures of the present invention are desirable in both low-temperature and high-temperature applications. The polymeric closures may be used in low-temperature applications such as an ambient or a cold fill. These applications include water, sports drinks, aseptic applications such as dairy products, and pressurized products such as carbonated soft drinks. It is contemplated that other low-temperature applications may be used with the polymeric closures of the present invention.

The polymeric closures of the present invention may be exposed to high-temperature applications such as hot-fill, pasteurization, and retort applications. A hot fill application is generally performed at temperatures around 185° F., while a hot-fill with pasteurization is generally performed at temperatures around 205° F. Retort applications are typically done at temperatures greater than 250° F. It is contemplated that the polymeric closures of the present invention can be used in other high-temperature applications.

What is claimed is:

1. A flip-top closure comprising:

a first closure portion including:

a polymeric top wall portion, a sealing mechanism, and a polymeric annular skirt portion depending from the polymeric top wall portion, the polymeric annular skirt portion including an internal thread formation for mating engagement with an external thread formation of a container; and a second closure portion including:

a polymeric tamper-evident band depending from and being partially detachably connected to the polymeric annular skirt portion by a frangible connection, the frangible connection extending partially around the periphery of the closure, wherein the first closure portion and the second closure portion are attached via at least one hinge, the at least one hinge assisting in moving the closure between an open position and a closed position after the frangible connection has been broken, wherein the at least one hinge includes a first hinge and a second hinge, wherein the frangible connection is a shark fin or wave shape nearing the first and the second hinges, wherein the frangible connection extends from about 225 degrees to about 325 degrees around the periphery of the closure.

2. The closure of claim 1, wherein the sealing mechanism is a polymeric continuous plug seal, the polymeric continuous plug seal depending from the polymeric top wall portion and being spaced inwardly from the polymeric annular skirt portion.

3. The closure of claim 1, wherein the shape of the closure is generally cylindrical.

4. The closure of claim 1, wherein the internal thread formation of the annular skirt portions includes at least one helical thread element.

5. The closure of claim 1, wherein the closure comprises polyolefins.

6. The closure of claim 1, wherein the hinge is adapted to flip at least about 150 degrees from a closed position to an open position.

7. The closure of claim 6, wherein the hinge is adapted to flip at least about 170 degrees from a closed position to an open position.

8. The closure of claim 1, wherein the frangible connection extends from about 275 degrees to about 325 degrees around the periphery of the closure.

9. The closure of claim 1, wherein the first closure portion further includes a flip tab, the flip tab being located generally opposite of the at least one hinge.

10. The closure of claim 1, wherein the remainder of the frangible connection is a generally straight line conforming with the periphery of the closure.

11. The closure of claim 1, wherein the first closure portion further includes a first projection being located between the first and second hinges, and wherein the second closure portion includes a second projection being located between the first and second hinges, the first and second projections being spaced apart from each other and assist in providing an audible sound when the closure is moved from a closed position to an open position.

12. The closure of claim 1, wherein the first and second closure portions assist to form spaces adjacent to the respective first and second hinges.

13. The closure of claim 1, wherein the flip-top closure is a one-piece closure.

14. A package comprising:

a container having a neck portion defining an opening, the container having an external thread formation on the neck portion; and a flip-top closure being configured for fitment to the neck portion of the container for closing the opening, the flip-top closure including a first closure portion and a second closure portion, the first closure portion including a polymeric top wall portion, a sealing mechanism, and a polymeric annular skirt portion depending from the polymeric top wall portion, the polymeric annular skirt portion including an internal thread formation for mating engagement with the external thread formation of the container, the second closure portion including a polymeric tamper-evident band depending from and being partially detachably connected to the polymeric annular skirt portion by a frangible connection, the frangible connection extending partially around the periphery of the closure, the first closure portion and the second closure portion being attached via at least one hinge, the at least one hinge assisting in moving the closure between an open position and a closed position after the frangible connection has been broke, the at least one hinge including a first hinge and a second hinge, the frangible connection being a shark fin or wave-like shape nearing the first and the second hinges, wherein the frangible connection extends from about 225 degrees to about 325 degrees around the periphery of the closure.

15. The package of claim 14, wherein the sealing mechanism is a polymeric continuous plug seal, the polymeric continuous plug seal depending from the polymeric top wall portion and being spaced inwardly from the polymeric annular skirt portion.

16. The package of claim 14, wherein the frangible connection extends from about 275 degrees to about 325 degrees around the periphery of the closure.

17. The package of claim 14, wherein the remainder of the frangible connection is a generally straight line conforming with the periphery of the closure.

18. The package of claim 14, wherein the first closure portion further includes a first projection being located between the first and second hinges, and wherein the second closure portion includes a second projection being located between the first and second hinges, the first and second projections being spaced apart from each other and assist in providing an audible sound when the closure is moved from a closed position to an open position.

19. A method of using a package including a flip-top closure and a container, the method comprising:

providing the container having a neck portion defining an opening, the container having an external thread formation on the neck portion;

providing the flip-top closure including a first closure portion and a second closure portion, the first closure portion including a polymeric top wall portion, a sealing mechanism, and a polymeric annular skirt portion depending from the polymeric top wall portion, the polymeric annular skirt portion including an internal thread formation for mating engagement with an external thread formation of a container, the second closure portion including a polymeric tamper-evident band depending from and being partially detachably connected to the polymeric annular skirt portion by a frangible connection, the frangible connection extending partially around the periphery of the closure, the first closure portion and the second closure portion being attached via at least one hinge, the flip-top closure being fitted to the neck portion of the container and in a closed position, the at least one hinge includes a first hinge and a second hinge, the frangible connection being a shark fin or wave shape nearing the first and the second hinges, the frangible connection extending from about 225 degrees to about 325 degrees around the periphery of the closure;

twisting the first and second closure portions so as to break the frangible connection partially connecting the tamper-evident band and the annular skirt portion; and after the frangible connection has been broken, flipping the closure from a closed position to an open position using the at least one hinge.

20. The method of claim 19 further including flipping the closure from the open position to the closed position and twisting the first and second closure portions to re-seal the package.

21. The method of claim 19, wherein the sealing mechanism is a polymeric continuous plug seal, the polymeric continuous plug seal depending from the polymeric top wall portion and being spaced inwardly from the polymeric annular skirt portion.

22. The method of claim 19, wherein the frangible connection extends from about 275 degrees to about 325 degrees around the periphery of the closure.

23. The method of claim 19, wherein the remainder of the frangible connection is a generally straight line conforming with the periphery of the closure.

24. A flip-top closure comprising:

a first closure portion including:

a polymeric top wall portion, a sealing mechanism, and a polymeric annular skirt portion depending from the polymeric top wall portion, the polymeric annular skirt portion including an internal thread formation for mating engagement with an external thread formation of a container; and a second closure portion including:

a polymeric tamper-evident band depending from and being partially detachably connected to the polymeric annular skirt portion by a frangible connection, the frangible connection extending partially around the periphery of the closure, wherein the first closure portion and the second closure portion are attached via at least one hinge, the at least one hinge assisting in moving the closure between an open position and a closed position after the frangible connection has been broken, wherein the at least one hinge includes a first hinge and a second hinge, wherein the frangible connection is a shark fin or wave-like-shape nearing the first and the second hinges, wherein the frangible connection extends from about 225 degrees to about 325 degrees around the periphery of the closure, wherein the first closure portion further includes a first projection being located between the first and second hinges, and wherein the second closure portion includes a second projection being located between the first and second hinges, the first and second projections being spaced apart from each other and assist in providing an audible sound when the closure is moved from a closed position to an open position, wherein a first space is formed between the first and second projections and the first hinge, and a second space is formed on the opposite side of the first hinge, wherein a third space is formed between the first and second projections and the second hinge, and a fourth space is formed on the opposite side of the second hinge.

25. The closure of claim 24, wherein the frangible connection extends from about 275 degrees to about 325 degrees around the periphery of the closure.

* * * * *